United States Patent [19]

Sato et al.

[11] Patent Number: 4,572,885

[45] Date of Patent: Feb. 25, 1986

[54] DEVELOPER COMPOSITION FOR DEVELOPING AN ELECTROSTATIC IMAGE

[75] Inventors: Keiji Sato; Takahira Kasuya; Goichi Yamakawa; Tsuneo Wada, all of Hachioji, Japan

[73] Assignee: Konishiroku Photo Industry Co., Ltd., Tokyo, Japan

[21] Appl. No.: 395,965

[22] Filed: Jul. 7, 1982

[30] Foreign Application Priority Data

Jul. 13, 1981 [JP] Japan ..... 56-108144
Jul. 20, 1981 [JP] Japan ..... 56-112116

[51] Int. Cl.[4] ..... G03G 9/16

[52] U.S. Cl. ..... 430/99; 430/108; 430/109; 430/126

[58] Field of Search ..... 430/126, 106.6, 107, 430/122, 109; 427/127

[56] References Cited

U.S. PATENT DOCUMENTS 3,507,686 4/1970 Hagenbach ..... 117/100
4,218,530 8/1980 Lu ..... 430/106.6
4,245,026 1/1981 Ziolo ..... 430/106.6
4,246,332 1/1981 Tanaka et al. ..... 430/109

FOREIGN PATENT DOCUMENTS 5396839 8/1978 Japan .
1442835 7/1976 United Kingdom .

*Primary Examiner*—John L. Goodrow
*Attorney, Agent, or Firm*—Frishauf, Holtz, Goodman & Woodward

[57] ABSTRACT

There are disclosed an electrostatic image developer which comprises a carrier comprising iron powder particles coated with a resin and a toner comprising a low molecular weight polypropylene, and an electrostatic image developer which further comprises as binder a homopolymer of a styrene or a copolymer of a styrene with an another vinyl monomer containing 10 to 70% by weight of a high molecular component having a molecular weight of 100,000 to 10,000,000.

The electrostatic image developer of the present invention can accomplish good developing without forming fogging even when provided in a great number of developments, thus exhibiting a great durability, and is also free from image contamination by the off-set phenomenon to give an excellent copied image.

28 Claims, No Drawings

DEVELOPER COMPOSITION FOR DEVELOPING AN ELECTROSTATIC IMAGE

This invention relates to a developer for developing an electrostatic image in the electrophotographic process, the electrostatic recording process and the electrostatic printing process.

In the electrophotographic process, a photosensitive material comprising a photoconductive element is charged uniformly on its surface in a dark place and then exposed to light to form an electrostatic image, which is in turn developed to form a visible image.

The methods for developing such electrostatic images may generally be classified broadly into the liquid developing method and the dry system developing method. The liquid developing method is a method in which development is performed by use of a liquid developer comprising various pigments or dyes dispersed as minute particles in an insulating organic liquid. On the other hand, the dry system developing method employs a mixture of a toner comprising a colorant such as carbon black, etc. dispersed in a natural or synthetic resin with a carrier such as iron, glass beads, etc. The carriers may also generally be classified into the insulating carriers and the electroconductive carriers. As the electroconductive carriers, there may be employed oxidized or unoxidized iron powders. Typical examples of insulating carriers may include those prepared by coating the surface of nucleus particles for carriers comprising magnetic materials such as iron, nickel, cobalt, ferrite, etc. with an insulating resin.

Among the dry system developing methods, in addition to the so-called hairbrush method, the impression method and the powder cloud method, in which a developer composed only of the principal component of the aforesaid toner is used, there are also the so-called magnetic brush method and the cascade method, in which a mixture of a carrier comprising iron powders or glass beads with a toner is used.

According to these developing methods, charge detecting particles such as toner particles having charges contained in a developer may be adhered onto the electrostatic image to form a visible image. This visible image may be transferred as such by heat, pressure, solvent vapor, etc. on a photosensitive material or other image supporting materials such as paper, followed by fixing.

The present invention relates to a developer to be used in the magnetic brush method and the cascade method among the above developing methods, namely an electrostatic image developer constituted of a toner and a carrier.

In the prior art, fixing has been performed by fusing the toner image obtained by developing directly onto a photoconductive photosensitive material or an electrostatic recording material supporting an electrostatic image, or alternatively by transferring once the toner image obtained by developing from the photoconductive photosensitive material or the electrostatic recording material to a transfer sheet such as paper before fusion thereof. During this operation, fusing of the toner image is effected either by contact with a solvent vapor or by a heating system. As the heating system, there may generally be employed the non-contact heating system by means of an electric furnace and the contact bonding heating system by means of a heated roller.

The contact bonding heating system using a heated roller performs fixing by permitting the toner image surface on the sheet to be fixed to pass under the roller while under pressure contact against the surface of the heat roller. The surface is formed of a material having releasable characteristics relative to the toner, and the method is generally called the heated roller fixing method. According to this method, since the surface of the heated roller is brought into pressure contact with the toner image surface of the sheet to be fixed, heat efficiency during fusion of the toner image on the sheet to be fixed is very good which enables rapid fixing. Thus, this method is very effective particularly for an electrophotographic copying machine of a transfer system in which high speed copying is intended.

However, according to this method, because the surface of the heated roller is pressure contacted with the toner image under the heated molten state, a part of the toner image may sometimes be adhered on the surface of the heated roller to be transferred thereon, whereby contamination may be caused on the sheet to be fixed. This is the so-called off-set phenomenon. For this reason, it is one of the essential elements in the heating fixing method to prevent the surface of the heated roller from adhering to the toner.

In the prior art, in order to prevent the heating roller surface from adhering to the toner, the surface of the heating roller is made of a material excellent in releasable characteristics such as a fluorine type resin and also the surface of the heating roller surface covered with a thin film of a liquid by supplying a liquid for prevention of off-set such as silicone oil to the surface thereof.

This method, while it is very effective in preventing the off-set phenomenon, suffers from the drawback of generation of odors through heating of the liquid for prevention of off-set. Further, since a device for supplying a liquid for prevention of off-set is required to be used, the mechanism of the copying apparatus becomes complicated with additional disadvantage of increased cost of the copying apparatus because of the high precision required to attain stable results. However, when no liquid for prevention of off-set is supplied, toner will be adhere to the surface of the fixing roller. Therefore, under the present situation, in spite of these drawbacks, supplying of the liquid for prevention of off-set must be performed.

British Pat. No. 1442835 describes in detail a toner containing an off-set preventive agent which has been developed to compensate for these drawbacks. By use of a toner containing an off-set preventive agent, even when no silicone oil is supplied onto the surface of a fixing roller, good heating roller fixing can be effected with good efficiency without generation of off-set phenomenon. Accordingly, the mechanism of the fixing device can be simplified simultaneously with improvement of precision, stability, and reliability of, for example, a high speed copying machine having assembled such a fixing device therein, and there is still an additional advantage of feasible decrease in cost.

However, a toner containing an off-set preventive agent is itself poor in flowing characteristics, exhibiting no free flowing property. When a developer is prepared by mixing a toner containing an off-set preventive agent with a carrier of uncoated iron powders, the off-set preventive agent existing on the surface of toner particles will migrate during prolonged usage to the surface of the uncoated carrier, thus contaminating the surface of the carrier or adhering to the surface thereof, resulting in deterioration of the developer. Under the present situation, no complete non-off-set characteristic has generally been achieved only by inclusion of polypropylene in the toner which is an off-set preventive agent. Therefore, for improvement of non-off-set characteristics, it is necessary to use a resin in combination, which resin itself has to a certain extent non-off-set characteristics.

That is, such a combination is a toner prepared by using a binder comprising a resin having a high molecular weight component and polypropylene.

On the other hand, a toner using as binder a styrene type resin containing a high molecular weight component having a molecular weight of 100,000 or more is very good with respect to non-off-set characteristics, but it is high in its softening point due to the high molecular weight component contained therein and, on the contrary, bad in fixing property. Accordingly, in this case, it is necessary to determine the resin for a binder with due consideration about the balance between the off-set generating temperature and the softening point by adding a low molecular weight component to lower its softening point.

In this case, however, a corresponding amount of a low molecular weight component is mixed in the resin reducing its durability as a developer. That is, a low molecular weight resin will be dislocated onto the carrier surface of the uncoated iron powders to contaminate the carrier surface. Thus, polypropylene which is the off-set preventive agent and the lower molecular weight component of the resin will contaminate the carrier surface. As the result, a developer constituted of an uncoated carrier and a toner comprising a resin containing polypropylene and a low molecular weight component will become unsuitable in frictional charging characteristic on the toner during usage for a long period of time to cause image density changes and generation of fogging.

More specifically, with the use of a developer, polypropylene which is the off-set preventive agent and the low molecular weight component resin will adhere to the particle surfaces of iron powder carriers, whereby the electric resistance of carrier particles will be increased to lower the bias current. The frictional charging characteristic will therefore be rendered unsuitable, resulting in lowering of image density formed and increase of fogging. As a consequence, early exchange of the developer becomes necessary to make the ultimate cost higher.

In order to overcome the above drawbacks, a highly durable developer has been needed, which contains an off-set preventive agent and is composed of a toner in which the binder comprises a low molecular weight component and a high molecular weight component.

The object of the present invention is to provide a developer which can realize high durability by use of a toner which enables good heating roller fixing with good efficiency without generation of off-set phenomenon, even when using a fixing roller which is supplied with no liquid for prevention of off-set on its surface.

The present inventors have found that the above object can be accomplished by a developer comprising an iron powder carrier coated with a resin and a toner comprising a lower molecular weight polypropylene or a developer comprising an iron powder carrier coated with a resin and a toner comprising as binder a homopolymer of a styrene or a copolymer of a styrene with an another vinyl monomer, which contains 10 to 70% by weight of a high molecular weight component having a molecular weight of 100,000 to 10,000,000, and a lower molecular weight polypropylene. That is, a developer comprising an iron powder carrier coated with a resin and a toner comprising a lower molecular weight polypropylene or such a developer in which the toner further comprising as a binder a homopolymer of a styrene or a copolymer of a styrene with an another vinyl monomer, containing 10 to 70% by weight of a high molecular weight component having a molecular weight of 100,000 to 10,000,000, has been found to be markedly small in transfer or fusion of the off-set preventive component contained in the toner surface to the carrier surface coated with a resin, as compared with the case when using an uncoated carrier, and excellent in durability, thus being suitable particularly for a high speed copying machine.

The carrier coated with a resin may have a spherical or an irregular shape, and it may be either electroconductive or insulating as resistance. Preferably, however, an insulating and spherical coated carrier is the most suitable.

In the present invention, as the resin for coating of iron powder particles of carrier, there may be employed such resins as homopolymers prepared by polymerization of monomers, including a styrene such as p-chlorostyrene, methylstyrene, etc.; vinyl halides such as vinyl chloride, vinyl bromide, vinyl fluoride, etc.; vinyl esters such as vinyl acetate, vinyl propionate, vinyl benzoate, vinyl butyrate, etc.; esters of $\alpha$-methylene aliphatic mono-carboxylic acids such as methyl acrylate, ethyl acrylate, n-butyl acrylate, isobutyl acrylate, dodecyl acrylate, n-octyl acrylate, 3-chloroethyl acrylate, phenyl acrylate, methyl $\alpha$-chloroacrylate, methyl methacrylate, ethyl methacrylate, butyl methacrylate, etc.; acrylonitrile, methacrylonitrile, acrylamide; vinyl ethers such as vinyl methyl ether, vinyl isobutyl ether, vinyl ethyl ether, etc.; vinyl ketones such as vinyl methyl ketone, vinyl hexyl ketone, methyl isopropenyl ketone, etc.; and other resins such as an epoxy resin, a rosin-modified phenol-formalin resin, a cellulose resin, a polyether resin, a polyvinyl butyral resin, a polyvinyl acetal resin, a polyester resin, a styrenebutadiene resin, a polyurethane resin, a polyvinylformal resin, a melamine resin, a polycarbonate resin, a fluorinated resin (e.g. Teflon, a homopolymer of tetrafluoroethylene, a copolymer of tetrafluoroethylene and hexafluoropropylene), etc., either alone or as a blend of two or more species.

The aforesaid resins may have any desired average molecular weights, but preferably in the range of from 50,000 to 300,000, most preferably from 100,000 to 200,000. Among them, a styrene-acrylic type resin (e.g. styrenemethyl methacrylate, styrene-butyl methacrylate, etc.), an epoxy resin, a styrene-butadiene resin, a butyral resin, and a cellulose resin are particularly useful.

When the photosensitive material comprises an organic photoconductive material, cadmium sulfide, etc. having a negatively charged characteristic, it is preferred to use such resins as fluorinated resins (e.g. Teflon), vinyl chloride resins, vinyl acetate resins, polyester resins, etc.

For preparation of the carrier to be used in the present invention, a resin as mentioned above is dissolved in a solvent to prepare a coating solution, which coating solution is then coated on the surface of iron powders as nucleus particles for carrier. For the purpose of this coating, there may be employed the dipping method, the spraying method, but it is preferred to use the fluidized bed method. The fluidized bed method comprises permitting the nucleus particles to rise through the bed until floated at an equilibrium height by a pressurized gas stream rising through a fluidized bed device, and spraying the aforesaid coating solution from above within the period before said nucleus particles fall again thereby to coat each particle, said procedure being repeated until a coated film with a desired thickness is formed. According to this method, uniform coating can be applied on each particle. The aforesaid coating solution may also contain a mixture of resins compatible with each other dissolved therein.

As the solvent to be used in the above operation, there may be employed any solvent which can dissolve the resin as described above, as exemplified by alcohols such as methanol, ethanol, butanol, isopropanol, etc.; halogenated hydrocarbons such as methylene chloride, dichloroethane, trichloroethylene, etc.; aromatic hydrocarbons such as toluene, xylene, etc.; ketones such as acetone, methyl ethyl ketone, etc.; other organic solvents such as tetrahydrofuran, dioxane, etc. or mixed solvents of these.

The iron powders to be used as nucleus particles to be used in the preparation as described above may have particle sizes of 10 to 1000 microns, particularly preferably 20 to 300 microns, and the coated layer of the resin may have a thickness of 0.1 to 10 micron, particularly preferably 0.2 to 5 micron.

In the present invention, as a resin for a binder which is a component of the toner, there may be employed such resins as homopolymers prepared by polymerization of a monomer, including a styrene such as p-chlorostyrene, methylstyrene, etc.; an ester of an α-methylene aliphatic mono-carboxylic acid such as methyl acrylate, ethyl acrylate, n-butyl acrylate, isobutyl acrylate, methyl methacrylate, ethyl methacrylate, butyl methacrylate, etc.; or other resins such as a copolymer of a styrene with an α-methylene aliphatic mono-carboxylic acid ester, a polyester resin, a polyvinyl butyral resin, a styrene-butadiene resin, etc., either alone or as a blend of two or more species.

Further, the toner according to the developer of the present invention may comprise a styrene type resin as a binder having 10 to 70% by weight of a high molecular weight component having a molecular weight of 100,000 to 10,000,000.

The styrene type resin to be used as a binder of the toner according to the present invention is a homopolymer or a copolymer of a styrene. The styrene herein are inclusive of, for example, styrene, o-methylstyrene, m-methylstyrene, p-methylstyrene, α-methyl styrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, 3,4-dichlorostyrene, etc.

When a copolymer of a styrene is selected for the aforesaid styrene type resin, a styrene-acrylic copolymer is particularly preferred. As the acrylic monomers for the acrylic component in such a copolymer, there may be mentioned acrylic acid or methacrylic acid derivatives, including α-methylene aliphatic mono-carboxylates such as methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-chloroethyl acrylate, phenyl acrylate, methyl-α-chloroacrylate, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate, stearyl methacrylate, phenyl methacrylate, dimethylaminoethyl methacrylate, diethylaminoethyl methacrylate, etc.; acrylonitrile, methacrylonitrile, acrylamide, and others. These monomers may be used either alone or as a combination of two or more species. And, particularly, a terpolymer comprising the three components of styrene-methyl methacrylate-butyl methacrylate is preferred. As another preferable styrene copolymer, there may be mentioned a styrene-butadiene copolymer. The styrene type resin as described above is required to contain 10 to 70% by weight of a high molecular weight component having a molecular weight of 100,000 to 10,000,000, preferably 10 to 50% by weight of a high molecular weight component having a molecular weight of 100,000 to 5,000,000. If a resin satisfying no such requirement is used, no high off-set generating temperature can be obtained. Such a styrene type resin containing a high molecular weight component can be prepared easily by suitable selection of the polymerization conditions or by formation of a crosslinked polymer utilizing a crosslinking agent.

The molecular weight herein used is determined according to the Gel Permeation Chromotography under the following conditions. The measurement is carried out by injecting 3 mg as sample weight of a tetrahydrofuran solution at a concentration of 0.4 g/dl, under the flow of tetrahydrofuran at a flow rate of 1 ml/min. at 25° C. In determination of the molecular weight of a sample, the measurement conditions are selected so that the molecular weight distribution possessed by said sample may be included within the scope wherein the logarithmic values of molecular weights of the calibration curve prepared from several mono-dispersed polystyrene standard samples versus count numbers will make a straight line. The above measurement was conducted by use of a device HLC-802UR produced by Toyo Soda Co., Ltd. and a column of TSK-GEL/CMH6.

A styrene-acrylic resin containing 10 to 70% by weight of a high molecular weight component having a molecular weight of 100,000 to 10,000,000 may be prepared according to, for example, the procedure as described below.

SYNTHESIS EXAMPLE

In a one liter separable flask, 0.1 g of "Gosenol GH-17" (produced by Nippon Gosei Co.) which is a partially saponified product of a polyvinyl alcohol is charged and dissolved in 100 ml of distilled water. A monomeric mixture A shown in the Table below is added into the resultant solution to be suspended therein and, after replacement of the gas phase with nitrogen gas, the mixture is heated to 80° C. and maintained thereat for 15 hours to carry out polymerization. Then, the reaction mixture is cooled to 40° C., and a monomeric mixture B shown in the Table below is added thereto and stirring continued at 40° C. for 2 hours. Subsequently, 100 ml of distilled water containing 0.4 g of the partially saponified product of a polyvinyl alcohol "Gosenol GH-17" is separately prepared and the aqueous solution is added to the suspension system. The mixture is thereafter heated again to 80° C. and maintained at said temperature for 8 hours to carry out polymerization, followed by elevation of the temperature up to 95° C., and further maintained thereat for 2 hours to complete polymerization. Then, after cooling, dehydration and washing are repeated, followed by drying, to give a resin. The resin has a number average molecular weight Mn of $1.1\times10^4$, a ratio of weight average molecular weight Mw to number average molecular weight Mn, i.e., Mw/Mn of 4.5 and a softening point of 140±2° C., as measured by the ball and ring method according to JIS (Japanese Industrial Standard) K 2531 - 1960.

| Monomeric mixture: | A (g) | B (g) |
|---|---|---|
| Styrene | 5 | 50 |
| Methyl methacrylate | 2 | 20 |
| Butyl methacrylate | 3 | 30 |
| Benzoyl peroxide | 0.02 | 2 |
| α-Methylstyrene (dimer) | — | 3 |

The above α-methylstyrene (dimer) is a mixture of 2,4-diphenyl-4-methyl-1-pentene and 2,4-diphenyl-4-methyl-2-pentene, a distilled fraction with a refractive index of 1.569, synthesized according to the method as disclosed in U.S. Pat. No. 2,429,719.

The polypropylene to be incorporated as an off-set preventive agent in the toner according to the present invention may desirably have a relatively low molecular weight for the relatively low fusion temperature required. A polypropylene having an average molecular weight of 1,000 to 45,000, particularly preferably 2,000 to 20,000, may effectively be used. In terms of the softening point measurement by the ball and ring method according to the JIS K 2531 - 1960, it is preferred to use a polypropylene having a softening point of 60° C. to 180° C., particularly preferably 100° C. to 160° C.

The polypropylene to be used in the present invention may also be a copolymer of propylene with other monomers such as a vinyl acetate or an ethylene, but it is preferable to use a homopolymer consisting only of propylene.

These useful polypropylenes are commercially available under the trade names of "Viscol 550P", "Viscol 660P", produced by Sanyo Kasei Kogyo Co. The polypropylene may be added in the toner in an amount generally of 0.1 to 50 parts by weight, particularly preferably of 1 to 20 parts by weight, per 100 parts by weight of the resin component in the toner.

The toner in the present invention comprises a resin as a binder and polypropylene as described above together with a colorant and other characteristic modifiers which may optionally be added.

A toner containing polypropylene will generally tend to be lowered in flowing characteristic. Therefore, an enhancer of flowing characteristic may be added in an amount of 0.1 to 5% by weight, preferably 0.2 to 2% by weight based on the toner component. As such an enhancer of flowing characteristic, there may be mentioned fine powdery silica "R-972" commercially available from Nippon Aerosil Co.

As colorants, there may be included carbon black, Nigrosine dye (C.I. No. 50415 B), Aniline Blue (C.I. No. 50405), Calco Oil Blue (C.I. No. azoec Blue 3), Chrome Yellow (C.I. No. 14090), Ultramarine Blue (C.I. No. 77103), Du Pont Oil Red (C.I. No. 26105), Quinoline Yellow (C.I. No. 47005), Methylene Blue Chloride (C.I. No. 52015), Phthalocyanine Blue (C.I. No. 74160), Malachite Green Oxalate (C.I. No. 42000), Lamp Black (C.I. No. 77266), Rose Bengal (C.I. No. 45435), mixtures thereof and others. These colorants are required to be contained in proportions sufficient to form visible images with sufficient densities, generally within the range of from about 1 to 20 parts by weight per 100 parts by weight of a binder.

The present invention is described in further detail below by referring to the following Examples, by which the present invention is not limited at all.

Preparation of carrier (1) Carrier 1

A coating solution was prepared by dissolving 5 g of a styrene-methyl methacrylate resin having an average molecular weight of 150,000 in 300 ml of methyl ethyl ketone, and 1 Kg of 200-300 mesh iron powders "EFVS" (produced by Nippon Teppun Co.) was added into said coating solution. After removal of the supernatant, the mixture was dried by blowing hot air thereagainst while stirring the mixture in a vat for photography, and then the powders were subjected to the heat treatment in an oven at 100° C. for 2 hours, thus providing Carrier 1 having coated a resin film. The Carrier 1 was found to have a resistivity of $2.3\times10^9$ ohm.cm.

The "resistivity" is a value measured by placing 1 g of a sample in a vessel having a concave portion of an area of 1 $cm^2$ and a depth of 1 cm with its inner bottom surface being made of a brass electrode, under the condition of a brass electrode with a weight of 1 kg mounted from above on the sample layer.

(2) Carrier 2

A coating solution was prepared by dissolving 3 g of a cellulose acetate butyrate resin in 300 ml of methyl ethyl ketone, and 1 Kg of 200-300 mesh steel iron powders "DSP-179D" (produced by Dowa Teppun Co.) was added into said coating solution. After removal of the supernatant, the mixture was dried by blowing-hot air thereagainst while stirring the mixture in a vat for photography, and then the powders were subjected to the heat treatment in an oven at 120° C. for 1 hour, thus providing Carrier 2 having coated a resin film. The Carrier 2 was found to have a resistivity of $4.5\times10^8$ ohm.cm.

(3) Carrier 3

In the same manner as in preparation of Carrier 1 except for using a coating solution containing 3 g of a methyl methacrylate-ethyl acrylate copolymer resin having an average molecular weight of 100,000 dissolved in 300 ml of methyl ethyl ketone and 1 kg of 200-300 mesh sintered iron powders "TEFVS" (produced by Nippon Teppun Co.) to obtain Carrier 3 having a coated resin film. The Carrier 3 was found to have a resistivity of $1.8\times10^6$ ohm. cm.

(4) Carrier 4

A coating solution was prepared by dissolving 20 g of an epoxy resin in 300 ml of methyl ethyl ketone, and sprayed using a fluidized bed device over 1 kg of spherical steel shots with average particle sizes of 100 micron under the condition of a fluidized drying temperature of 60° C., followed by the heat treatment of the powders in an oven at 100° C. for 2 hours, to provide Carrier 4 having a coated resin film. The Carrier 4 was found to have a resistivity of $10^{14}$ ohm.cm or higher.

(5) Carrier 5

According to the same procedure as in preparation of Carrier 4 except for using a polyvinyl butyral resin "Ethlec B" (produced by Sekisui Kagaku Co.) in place of the epoxy resin, there was obtained Carrier 5 having a coated resin film. The Carrier 5 was found to have a resistivity of $6.8\times10^{13}$ ohm.cm.

(6) Carrier 6

According to the same procedure as in preparation of Carrier 4 except for using a styrene-butyl methacrylate resin having an average molecular weight of 130,000 as a resin for coating and iron powders "DSP-135C" (produced by Dowa Teppun Co.), there was obtained Carrier 6 having a coated resin film. The Carrier 6 was found to have a resistivity of $10^{14}$ ohm.cm or higher.

Preparation of toner (1) Toner 1

After 100 parts by weight of a polystyrene resin "Picolastic D-125" (produced by Esso Co.), 5 parts by weight of a low softening point polypropylene "Viscol 660P" (produced by Sanyo Kasei Kogyo Co.) and 10 parts by weight of carbon black were mixed in a ball mill, kneading, pulverization and classification were conducted according to a conventional procedure for preparation of toner to give a toner with an average particle size of 11 micron. For improvement of flowing characteristic, 1% by weight of a hydrophobic silica "R-972" (produced by Nippon Aerosil Co.) was added to the toner to be dispersed therein to provide Toner 1.

(2) Toner 2

Using 100 parts by weight of a styrene-acrylic resin "Ethlec" (produced by Sekisui Kagaku Co.) and 4 parts by weight of a low softening point polypropylene "Viscol 550 P" (produced by Sanyo Kasei Kogyo Co.), a toner with an average particle size of 11.2 micron was obtained according to the same method as in preparation of Toner 1, and 0.5% by weight of a hydrophobic silica "R-972" was added and dispersed in said toner to provide Toner 2.

(3) Toner 3

Using 100 parts by weight of a polyester resin (an experimental sample available from Kao Sekken Kogyo Co.), 3.5 parts by weight of a polypropylene "Viscol 660 P" and 10 parts by weight of carbon black, a toner with an average particle size of 12.1 micron was obtained according to the same method as in preparation of Toner 1, and 1.5% by weight of a hydrophobic silica "R-972" was added and dispersed in said toner to provide Toner 3.

(4) Toner 4

Using 100 parts by weight of a styrene-acrylic resin "Ethlec" (produced by Sekisui Kagaku Co.), 5 parts by weight of a polypropylene "Viscol 660 P" and 10 parts by weight of carbon black, there was obtained Toner 4 with an average particle size of 11.6 micron according to the same method as in preparation of Toner 1.

(5) Toner 5

100 Parts by weight of a styrene-acrylic resin containing 25% by weight of a high molecular weight component having a molecular weight of 100,000 or more "Ethlec" (produced by Sekisui Kagaku Co.), 3.5 parts by weight of a low softening point polypropylene "Viscol 660 P" (produced by Sanyo Kasei Kogyo Co.) and 10 parts by weight of carbon black were mixed in a ball mill, followed by kneading, pulverization and classification according to a conventional procedure for preparation of toner to provide Toner 5 with an average particle size of 11.6 micron.

(6) Toner 6

Using 100 parts by weight of a styrene-2-ethylhexyl acrylate containing 15% by weight of a high molecular weight component having a molecular weight of 100,000 or more (softening point: 138° C.), 5 parts by weight of a low softening point polypropylene "Viscol 660 P" and 10 parts by weight of carbon black, Toner 6 with an average particle size of 12.9 was obtained similarly as in preparation of Toner 1.

(7) Toner 7

Using 100 parts by weight of a styrene-acrylic resin containing 38% by weight of a high molecular weight component having a molecular weight of 100,000 or more (sample produced by Sekisui Kagaku Co.), 4 parts by weight of a low softening point polypropylene "Viscol 550 P" (produced by Sanyo Kasei Kogyo Co.) and 10 parts by weight of carbon black, Toner 7 with an average particle size of 12.9 micron was obtained similarly as in preparation of Toner 1.

EXAMPLE

By mixing one kind of the Carriers 1-6 as set forth above in combination with one kind of the Toners 1-7 as shown in the following Table at the proportion so as to give the toner concentration (% by weight) as shown in the same Table, there were prepared 12 kinds as a total of the electrostatic image developers of the present invention. Each developer was subjected to durability test by continuous copying by using an electrophotographic copying machine "U-Bix W (remodeled type)" (produced by Konishiroku Photo Industry Co.). The results are as shown in the Table. In the Table, "high molecular weight component" represents a component of binder in toner with a molecular weight of 100,000 or more.

| Developer No. | Carrier | Toner | High molecular weight component (wt. %) | Toner concentration (wt. %) | Durability (number of continuous copying) |
|---|---|---|---|---|---|
| 1 | Carrier 1 | Toner 1 | — | 5 | over 20,000 |
| 2 | Carrier 2 | Toner 2 | — | 5 | over 20,000 |
| 3 | Carrier 3 | Toner 3 | — | 5 | over 20,000 |
| 4 | Carrier 4 | Toner 4 | — | 2 | over 30,000 |
| 5 | Carrier 5 | Toner 1 | — | 2 | over 20,000 |
| 6 | Carrier 6 | Toner 2 | — | 2 | over 30,000 |
| 7 | Carrier 1 | Toner 5 | 25 | 5 | over 20,000 |
| 8 | Carrier 2 | Toner 6 | 15 | 5 | over 20,000 |
| 9 | Carrier 3 | Toner 7 | 38 | 5 | over 20,000 |
| 10 | Carrier 4 | Toner 5 | 25 | 2 | over 30,000 |
| 11 | Carrier 5 | Toner 6 | 15 | 2 | over 30,000 |
| 12 | Carrier 6 | Toner 7 | 38 | 5 | over 30,000 |

As can be understood from the above results, the electrostatic image developer of the present invention can accomplish good developing without forming fogging even when provided in a great number of developments, thus exhibiting a great durability, and is also free from image contamination by the off-set phenomenon to give an excellent copied image.

COMPARATIVE EXAMPLE 1

A developer was prepared by mixing 5 parts by weight of a toner with an average particle size of 12.6 micron, prepared similarly as in preparation of Toner 1 by use of 100 parts by weight of a styrene-acrylic resin "Ethlec" (produced by Sekisui Kagaku Co.), 5 parts by weight of a polypropylene "Viscol 660P" and 10 parts by weight of carbon black, with 95 parts by weight of a carrier comprising iron powders "EFV" (produced by Nippon Teppun Co.). Using this developer, durability test was conducted in the same manner as in Example, whereby fogging was formed in the copied image before copying number reached 10,000 times to prove that the developer cannot practically be used.

COMPARATIVE EXAMPLE 2

A comparative developer was prepared from a toner, prepared in the same manner as in preparation of Toner 1 except for using a styrene-acrylic resin containing 8% by weight of a high molecular weight having a molecular weight of 100,000 or more as binder, and Carrier 1 as already described above. This developer was subjected to the same durability test as in Example, whereby contamination due to off-set phenomena became so excessive, being also accompanied by generation of fogging, before the copying number reached 10,000 times, that the experiment was discontinued.

COMPARATIVE EXAMPLE 3

Another comparative developer was prepared from 200–300 mesh iron powders "EFV-III" (produced by Nippon Teppun Co.) and Toner 1 as already described above, and subjected to the durability test as in Example. As the result, fixing characteristic was sufficient, but fogging was observed to be generated before copying number reached 10,000 times and the experiment was discontinued.

We claim:

1. A developer for developing an electrostatic image, which comprises a carrier comprising iron powder particles coated with a resin selected from the group consisting of a resin containing structural units of an $\alpha$, $\beta$-unsaturated ethylenic monomer, an epoxy resin, a cellulose resin, a polyvinyl butyral resin, a styrene-butadiene resin and a fluorinated resin and a toner comprising a having a softening point of 60° to 180° C. polypropylene.

2. The developer according to claim 1, wherein the toner further comprises a binder selected from a homopolymer of a styrene containing compound and a copolymer of said styrene containing compound with a vinyl monomer, said homopolymer and copolymer containing 10 to 70% by weight of a high molecular weight component having a molecular weight of 100,000 to 10,000,000.

3. The developer according to claim 1 or 2, wherein said polypropylene is selected from the group consisting of a homopolymer of propylene, a copolymer of propylene and ethylene, and a copolymer of propylene and vinyl acetate.

4. The developer according to claim 1 or 2, wherein said polypropylene has a softening point of 100° to 160° C.

5. The developer according to claim 1 or 2, wherein said polypropylene has an average molecular weight of 1,000 to 45,000.

6. The developer according to claim 2, wherein said styrene containing compound is styrene.

7. The developer according to claim 2, wherein said another vinyl monomer is an $\alpha,\beta$-unsaturated ethylenic monomer.

8. The developer according to claim 7, wherein said $\alpha,\beta$-unsaturated ethylenic monomer is an $\alpha$-methylene aliphatic mono-carboxylic acid ester.

9. The developer according to claim 8, wherein said $\alpha$-methylene aliphatic mono-carboxylic acid ester is an acrylate or a methacrylate.

10. The developer according to claim 2, wherein said another vinyl monomer is a butadiene.

11. The developer according to claim 2, wherein said polymer contains 10 to 50% by weight of a high molecular weight component having a molecular weight of 100,000 to 5,000,000.

12. The developer according to claim 1, wherein said resin containing structural units of an $\alpha,\beta$-unsaturated ethylenic monomer is a copolymer of a styrene containing compound and an $\alpha$-methylene aliphatic mono-carboxylic acid ester.

13. The developer according to claim 12, wherein said styrene is styrene containing compound.

14. The developer according to claim 12, wherein said $\alpha$-methylene aliphatic mono-carboxylic acid ester is an acrylate or a methacrylate.

15. The developer according to claim 12, wherein said copolymer is a copolymer of a styrene containing compound and an acrylate or a styrene containing compound and a methacrylate.

16. The developer according to claim 1, wherein said resin has an average molecular weight of 50,000 to 300,000.

17. The developer according to claim 1, wherein said $\alpha,\beta$-unsaturated ethylenic monomer is at least one selected from the group consisting of a styrene containing compound, a vinyl halide, a vinyl ester, an $\alpha$-methylene aliphatic mono-carboxylic acid ester, a vinyl ether and a vinyl ketone.

18. The developer according to claim 17, wherein said $\alpha$-methylene aliphatic mono-carboxylic acid ester is an acrylate or a methacrylate.

19. The developer according to claim 1, wherein said fluorinated resin is selected from the group consisting of a homopolymer of tetrafluoroethylene, and a copolymer of tetrafluoroethylene and hexafluoropropylene.

20. The developer according to claim 1, wherein the toner further comprises a binder having at least one member selected from the group consisting of a homopolymer of a styrene containing compound, a homopolymer of an $\alpha$-methylene aliphatic mono-carboxylic acid ester, a copolymer of a styrene containing compound and an $\alpha$-methylene aliphatic mono-carboxylic acid ester, a polyester resin, a polyvinyl butyral resin and a styrene-butadiene resin.

21. The developer according to claim 20, wherein said styrene containing compound is styrene.

22. The developer according to claim 20, wherein said $\alpha$-methylene aliphatic mono-carboxylic acid ester is an acrylate or a methacrylate.

23. The developer according to claim 20, wherein said copolymer of a styrene containing compound and $\alpha$-methylene aliphatic mono-carboxylic acid ester is a copolymer of a styrene containing compound and an acrylate or a copolymer of a styrene containing compound and a methacrylate.

24. The developer according to claim 23, wherein said copolymer is a copolymer of styrene, methyl methacrylate and butyl methacrylate

25. The developer according to claim 20, wherein said styrene-butadiene resin is a copolymer of styrene and butadiene.

26. In a method for forming a toner image comprising uniformly charging a photoconductive element, exposing imagewise said electrically charged photoconductive element to light to form imagewise an electrostatic latent image, developing said electrostatic latent image with a developer comprising toner and carrier, transferring said toner image formed on said photoconductive element onto a transfer sheet and fixing said transferred toner image on said transfer sheet by bringing said transfer sheet into pressure contact with a heated roller, the improvement which comprises said developer comprising a carrier comprising iron powder particles coated with a resin selected from the group consisting of resin containing structural units of an $\alpha$, $\beta$-unsaturated ethylenic monomer, an epoxy resin, a cellulose resin, a polyvinyl butyral resin, a styrene-butadiene resin and a fluorinated resin and a toner comprising a polypropylene having an average molecular weight of 1,000 to 45,000.

27. The method for forming a toner image according to claim 26, wherein the toner further comprises a binder selected from a homopolymer of a styrene containing compound and a copolymer of said styrene containing compound with a vinyl monomer, said homopolymer and copolymer containing 10 to 70% by weight of a high molecular weight component having a molecular weight of 100,000 to 10,000,000.

28. The method for forming a toner image according to claim 26 or 27, wherein said polypropylene is selected from the group consisting of a homopolymer of propylene, a copolymer of propylene and ethylene, and a copolymer of propylene and vinyl acetate.

* * * * *